US012687377B2

(12) United States Patent
Choi

(10) Patent No.: US 12,687,377 B2
(45) Date of Patent: Jul. 21, 2026

(54) SMART SHELL

(71) Applicant: Jong Tae Choi, Seoul (KR)

(72) Inventor: Jong Tae Choi, Seoul (KR)

( * ) Notice: Subject to any disclaimer, the term of this patent is extended or adjusted under 35 U.S.C. 154(b) by 0 days.

(21) Appl. No.: 18/832,603

(22) PCT Filed: Dec. 15, 2023

(86) PCT No.: PCT/KR2023/020751
§ 371 (c)(1),
(2) Date: Jul. 24, 2024

(87) PCT Pub. No.: WO2024/191011
PCT Pub. Date: Sep. 19, 2024

(65) Prior Publication Data

US 2026/0177364 A1 Jun. 25, 2026

(30) Foreign Application Priority Data

Mar. 13, 2023 (KR) ..... 10-2023-0032788

(51) Int. Cl.
*F42B 12/64* (2006.01)

(52) U.S. Cl.
CPC ..... *F42B 12/64* (2013.01)

(58) Field of Classification Search
CPC ..... F42B 12/60; F42B 12/62; F42B 12/625; F42B 12/64; F42B 12/66; F42B 12/58; F42B 12/56; F42B 12/70; F42B 12/367; F42B 12/362; F42B 10/48; F42B 10/50; F42B 10/52; F42B 10/54
See application file for complete search history.

(56) References Cited

U.S. PATENT DOCUMENTS

| | | | | | |
|---|---|---|---|---|---|
| 136,336 | A * | 2/1873 | Paine | F42B 12/64 | 102/456 |
| 785,285 | A * | 3/1905 | Wratzke | F42B 12/60 | 102/497 |
| 965,278 | A * | 7/1910 | Brust | F42B 10/40 | 102/490 |
| 1,039,850 | A * | 10/1912 | Voeller | F42B 12/60 | 102/497 |
| 1,198,035 | A * | 9/1916 | Huntington | F42B 12/66 | 102/504 |
| 1,294,059 | A * | 2/1919 | DeCase | F42B 12/64 | 102/456 |

(Continued)

FOREIGN PATENT DOCUMENTS

| | | |
|---|---|---|
| KR | 10-1999-0037551 | 5/1999 |
| KR | 10-1500640 | 3/2015 |
| KR | 10-2589075 | 10/2023 |

*Primary Examiner* — Derrick R Morgan
(74) *Attorney, Agent, or Firm* — LEX IP MEISTER, PLLC

(57) ABSTRACT

According to an embodiment of the present invention, a smart shell mounted on a gun barrel having a rifle formed on an inner circumference, and formed to hit a military target area by using a plurality of scattering pieces includes: a warhead part having the scattering pieces embedded therein; a cover part having one or more grooves provided on an outer circumference and coupled to cover the warhead part, and separated from the warhead part by a difference in rotational speed relative to the warhead part when close to the target area; and a propulsion part providing a propulsion force to the warhead part.

5 Claims, 3 Drawing Sheets

(56) References Cited

U.S. PATENT DOCUMENTS 1,464,192 A * 8/1923 Willson ..... F42B 12/66 102/504
2,304,060 A * 12/1942 Baylor ..... F42B 12/64 102/497
2,321,128 A * 6/1943 Clark ..... F42B 12/204 102/500
2,412,151 A * 12/1946 Holmes, Jr. ..... F42B 12/58 102/480
2,476,973 A * 7/1949 Gillon ..... F42B 12/58 102/393
2,809,583 A * 10/1957 Ortynsky ..... F42B 12/58 89/1.51
3,093,072 A * 6/1963 Pigman ..... F42B 12/60 102/393
3,318,241 A * 5/1967 Gould ..... F42B 12/58 89/1.813
3,374,740 A * 3/1968 Voda ..... F42B 12/58 102/370
3,656,433 A * 4/1972 Thrailkill ..... F42B 5/03 102/455
3,721,196 A * 3/1973 Willis ..... F42B 12/70 102/505
3,765,336 A * 10/1973 Kulsik ..... F42B 12/70 102/505
3,802,345 A * 4/1974 La Costa ..... F42B 5/03 42/78
3,842,741 A * 10/1974 Brothers ..... F42B 12/625 102/490
3,881,416 A * 5/1975 Dilworth, Jr. ..... F42B 12/64 102/703
3,938,442 A * 2/1976 Donadio ..... F42B 12/64 102/494
3,954,060 A * 5/1976 Haag ..... F42B 12/64 102/494
4,115,775 A * 9/1978 Harrington ..... H01Q 1/28 342/13
4,195,571 A * 4/1980 Beeker ..... F42B 12/70 102/505
4,638,737 A * 1/1987 Mclngvale ..... F41H 5/007 102/703
4,676,167 A * 6/1987 Huber, Jr. ..... F41B 3/04 102/393
4,922,826 A * 5/1990 Busch ..... F42B 12/64 102/357
4,957,046 A * 9/1990 Puttock ..... F42B 12/64 102/480
5,005,483 A * 4/1991 Deffayet ..... F42B 12/60 102/357
5,164,538 A 11/1992 McClain III
5,932,836 A * 8/1999 White ..... F42B 10/48 102/529
8,196,514 B2 * 6/2012 Gustafsson ..... F42B 12/62 102/489
9,068,807 B1 * 6/2015 Thomas ..... F42B 10/02
10,197,365 B1 * 2/2019 Blyskal ..... F41H 13/0006
10,466,023 B2 * 11/2019 Garst ..... F42B 7/046
11,561,075 B2 * 1/2023 Allison ..... F42B 12/62
12,366,436 B1 * 7/2025 Hardy ..... F42B 12/20
2002/0166475 A1 * 11/2002 Brooks ..... F42B 12/60 102/489
2004/0129162 A1 * 7/2004 Lloyd ..... F42C 19/095 102/494
2007/0034073 A1 * 2/2007 Banks ..... F42B 12/62 89/1.815
2007/0101892 A1 5/2007 Rastegar
2009/0078146 A1 * 3/2009 Tepera ..... F42B 12/60 102/501
2014/0130696 A1 * 5/2014 DeJong ..... F42B 7/10 102/448
2015/0308803 A1 * 10/2015 Caillaut ..... F42B 12/64 102/506
2019/0301844 A1 * 10/2019 Garst ..... F42B 10/26
2020/0348115 A1 * 11/2020 Garst ..... F42B 10/16
2022/0170724 A1 * 6/2022 Forge ..... F42B 12/64

* cited by examiner

SMART SHELL

TECHNICAL FIELD

Embodiments of the present invention relate to a smart shell that may intercept drones or unmanned aerial vehicles.

BACKGROUND ART

The number of cases of scouting or attacking military or civilian facilities using drones or unmanned aerial vehicles is increasing both in Korea and overseas. The drones or unmanned aerial vehicles may be detected using the naked eye or radar, and intercepted using anti-aircraft defense systems such as missiles or anti-aircraft guns.

A method of detecting the unmanned aerial vehicles or drones is used by improving a signal processing technique of the existing radar system in Korea, and a method of capturing the unmanned aerial vehicles or drones with a net is used by mobilizing a separate manned helicopter overseas. Some facilities have used methods such as detecting and tracking the drones with an optical apparatus and capturing the drones using nets, but methods for eliminating threatening attacks are insufficient and an ability to accurately identify whether a detection target at a remote distance is a drone, bird, or clutter is insufficient, and there is a lack of removal methods for drones (unmanned aerial vehicles) that move and attack at high speeds.

Because expensive missiles may not be used to eliminate the drones or unmanned aerial vehicles, the present invention intends to consider a new method that improves shells used in anti-aircraft systems, including existing anti-aircraft guns, to intercept not only the drones or unmanned aerial vehicles, but also one or more targets within a target area.

DISCLOSURE

Technical Problem

An object of the present invention is to provide a smart shell which may have a more enhanced structure, and intercept one or more targets in a target area or intercept a target which is evasively maneuvered.

Technical Solution

In order to achieve the technical object of the present invention, a smart shell mounted on a gun barrel having a rifle formed on an inner circumference, and formed to hit a military target area by using a plurality of scattering pieces according to an embodiment of the present invention includes: a warhead part having the scattering pieces embedded therein; a cover part having one or more grooves provided on an outer circumference and coupled to cover the warhead part, and separated from the warhead part by a difference in rotational speed relative to the warhead part when close to the target area; and a propulsion part providing a propulsion force to the warhead part.

According to one example related to the present invention, the smart shell may further include a speed control assembly coupled to the cover part to limit a shape of the groove by covering at least a portion of the groove.

According to one example related to the present invention, the speed control assembly includes a cover portion covering the groove, a coupling portion coupled to the cover part, and a connection portion connecting the cover portion and the coupling portion, and formed to have a relatively thinner cross-section relative to the cover portion and the coupling portion.

According to one example related to the present invention, the cover portion and the groove are formed to be separated from each other by a predetermined interval, and one side of the cover portion is formed to be thicker than the other side.

According to one example related to the present invention, the smart shell further includes a sealing part inserted between the cover part and the warhead part, and the sealing part is formed to be damaged when the rotational speed difference is equal to or more than a predetermined level.

Advantageous Effects

The smart shell related to at least one embodiment of the present invention configured as described above may simultaneously hit one or more targets in a target area or effectively intercept an aerial vehicle that is evasively maneuvered.

Further, an air defense network using artillery may be constructed more inexpensively by using existing artillery.

In addition, by replacing a propellant or a groove in a cover part embedded in the shell, an effective defense network may be formed depending on a target.

MODE FOR INVENTION

Hereinafter, a specific embodiment for carrying out the present invention will be described with reference to the drawings. The embodiment of the present invention is intended to describe one invention, and the scope of rights is not limited to the illustrated embodiment, and the illustrated drawings are limited to the drawings because only key content is enlarged and incidental details are omitted for clarity of the present invention. Suffixes "module" and "unit" for components used in the following description are given or mixed in consideration of easy preparation of the present disclosure only and do not have their own distinguished meanings or roles. In this specification, the same or similar reference numbers are assigned to the same or similar components even in different embodiments, and the description is replaced with the first description. A singular form used in the present specification may include a plural form if there is no clearly opposite meaning in the context.

Figure 1:
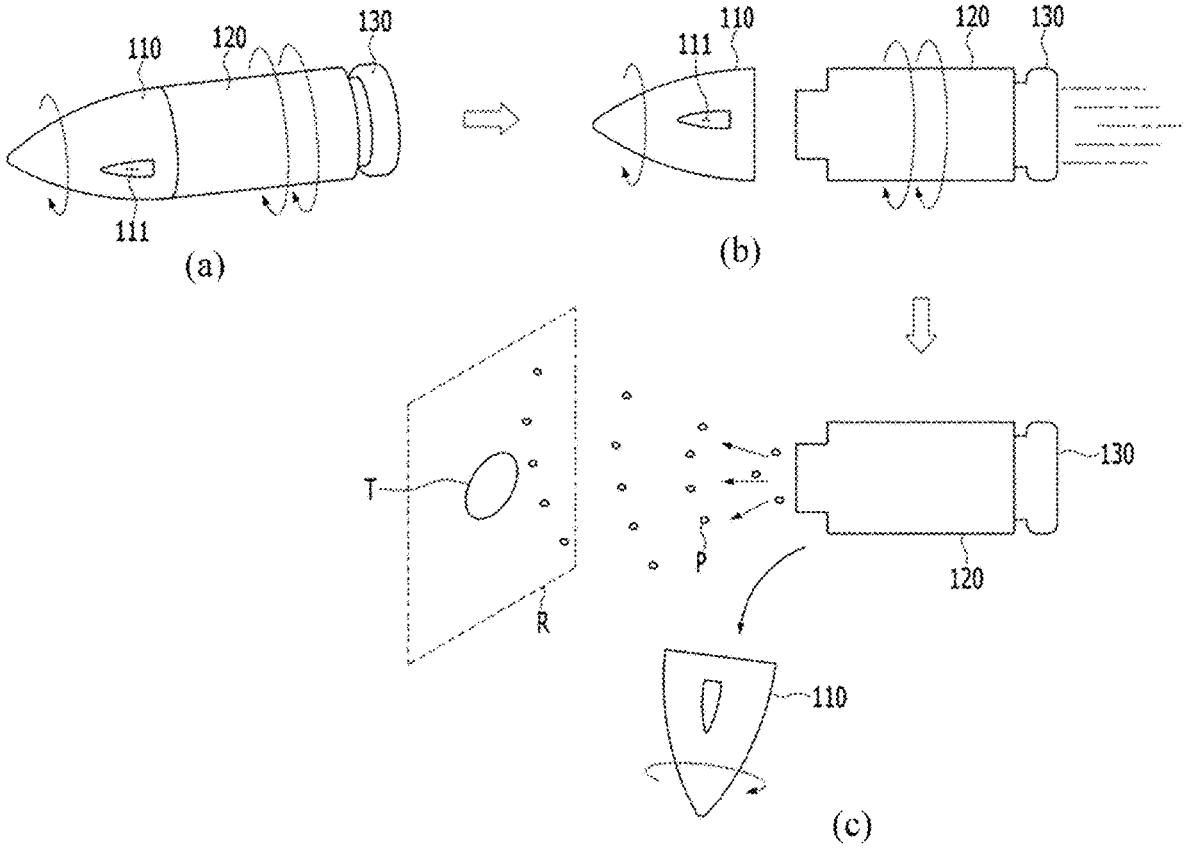
FIG. 1 is a diagram illustrating each step after a smart shell is launched according to an embodiment of the present invention.
Figure 2:
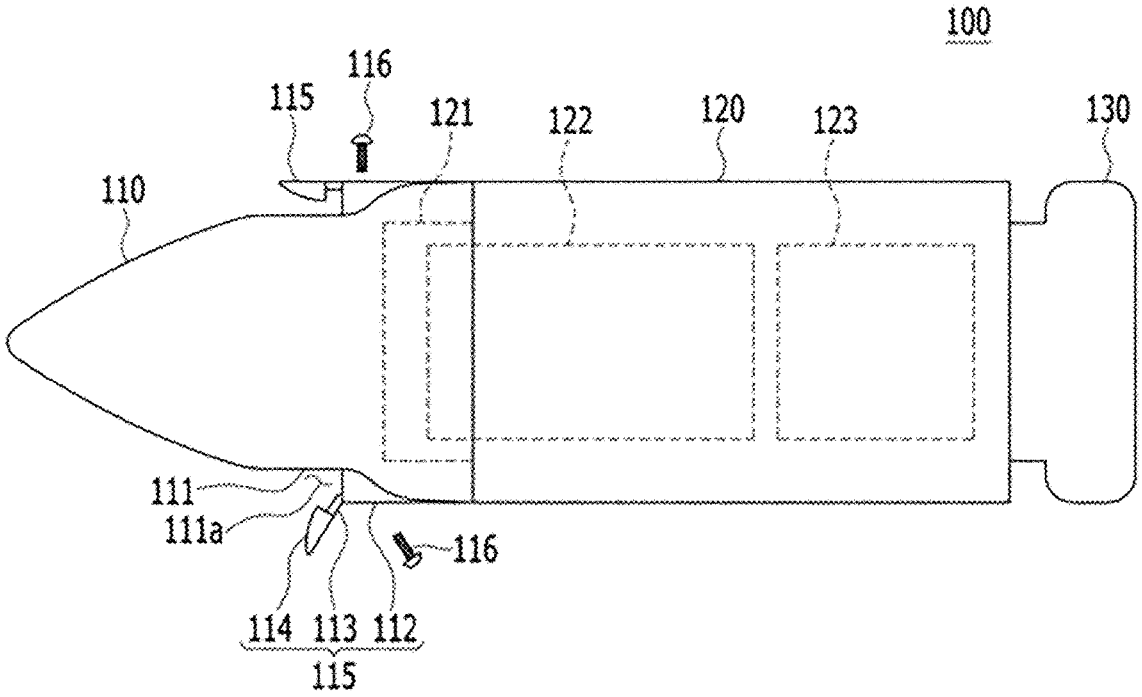
FIG. 2 is a conceptual view of the smart shell according to an embodiment of the present invention.
Figure 3:
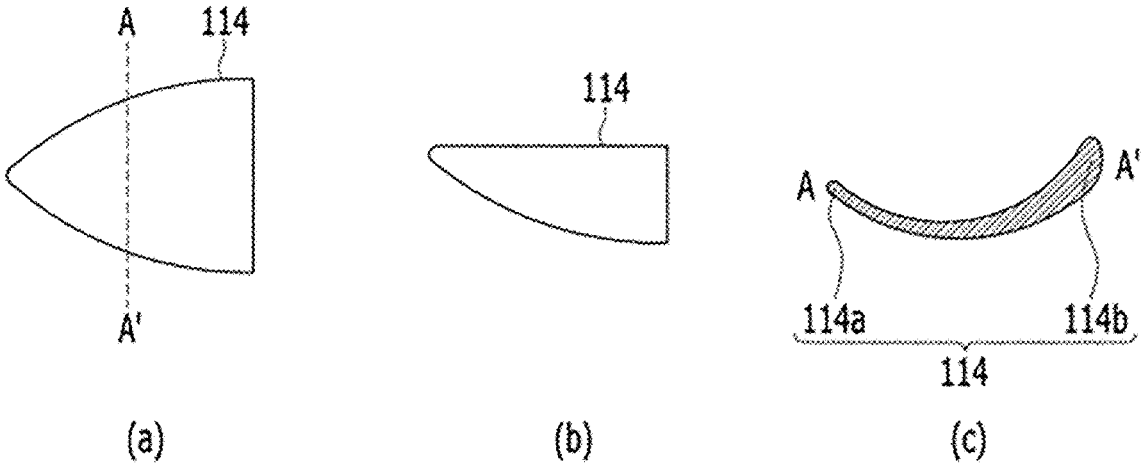
FIG. 3 illustrates diagrams illustrating a plan view and a side view, and a cross-sectional view taken along line A-A' of a connection part illustrated in FIG. 2.

FIG. 1 is a diagram illustrating each step (FIG. 1A-FIG. 1B-FIG. 1C) after a smart shell 100 is launched according to an embodiment of the present invention, FIG. 2 is a conceptual view of the smart shell 100 according to an embodiment of the present invention, and FIG. 3 illustrates diagrams illustrating a plan view and a side view, and a cross-sectional view taken along line A-A' of a connection part illustrated in FIG. 2.

Referring to FIGS. 1 to 3, the smart shell 100 according to an embodiment of the present invention includes a warhead part 120, a cover part 110, and a propulsion part 130.

The warhead part 120 includes a first part 122 in which scattering pieces P are embedded, and a second part 123 in which a fuse and a high explosive activated when the cover part 110, which will be described later, is separated are embedded. The scattering pieces P are at least partially made of a metal material, so that when the high explosive explodes, the scattering pieces P scatter forward and hit a target T.

The cover part 110 is detachably coupled to the warhead part 120 so as to cover an upper portion of the warhead part 120. The cover part 110 may have a screw groove on an inner circumference thereof, and the warhead part 120 may have a screw thread on an upper outer circumference correspondingly. Unlike this, although not illustrated in FIG. 2, a portion of the cover part 110 may also be formed to be inserted into the warhead part 120 in a separate embodiment. In this case, the screw groove may be formed on the inner circumference of the warhead part 120 and the screw thread may be formed on the outer circumference of the cover part 110.

The cover part 110 includes one or more grooves 111 on the outer circumference thereof, and the grooves 111 cause a difference in rotational speed relative to the warhead part 120 of the shell in a rifling type shell. For example, when the warhead part 120 has a rotational speed of 1, the cover part 110 may have a rotational speed of 0.8 due to the groove 111.

Referring to FIG. 1, after the shell is launched (FIG. 1A), when the shell approaches a target area R, the shell reaches a maximum speed thereof and then gradually slows down, and at this time, the rotational speed of the cover part 110 is rapidly reduced compared to the warhead part 120 due to air resistance.

As a result, the cover part 110 may be separated from the warhead part 120. That is, the cover part 110 may be separated from the warhead part 120 at a specific position (FIG. 1B), and one or more scattering pieces P may be launched into the target area R by the explosion of the embedded high explosive that is ignited upon separation (FIG. 1C).

The rotational speed of the cover part 110 may vary depending on the shape or position of the groove 111 formed on the outer circumference of the cover part 110. A speed control assembly 115 is coupled to the cover part 110 so as to cover at least a portion of the cover part 110 in order to control the rotational speed of the cover part 110, and a time when the cover part 110 is separated from the warhead part 120. The speed control assembly 115 is formed to limit the shape of the groove 111 formed in the cover part 110. The speed control assembly 115 includes a cover portion 114, a coupling portion 112, and a connection portion 113. The cover portion 114 is a portion which covers the groove 111 in the speed control assembly 115, and the coupling portion 112 is a portion where the speed control assembly 115 is coupled to the cover part 110. The connection portion 113 is formed to connect the cover portion 114 and the coupling portion 112, and the connection portion 113 is formed to have a thinner cross-section than the coupling portion 112 or the cover portion 114. This induces the connection portion 113 to be bent toward the outside other than the inside of the groove 111 by the air resistance at a predetermined rotational speed.

Referring to FIG. 3, one side 114*b* of the cover portion 114 is formed to be thicker than the other side 114*a*. When the connection portion 113 is bent to the outside, this is to induce eccentricity in the cover portion 114 and generate more air resistance when rotating. If the cover part 110 rotates from left to right, the left side becomes one side which is formed to be thicker. This is to receive more air resistance and cause vibration due to vortices.

A sealing part may be formed between the cover part 110 and the warhead part 120 to maintain internal airtightness. A material forming the sealing part may be a rubber, synthetic resin, or metallic material.

The propulsion part 130 has a propellant charge and ignition agent embedded therein, and a hammer mounted on the gun destroys the ignition agent and is fired forward. Depending on a method of maintaining the attitude of the shell during flight, the shell is divided into a smoothbore type and a rifling type, and in the case of the present invention, the shell is enabled to be applied to both the smoothbore type and the rifling type, but the shell is more suitable for the rifling type.

Figure 4:
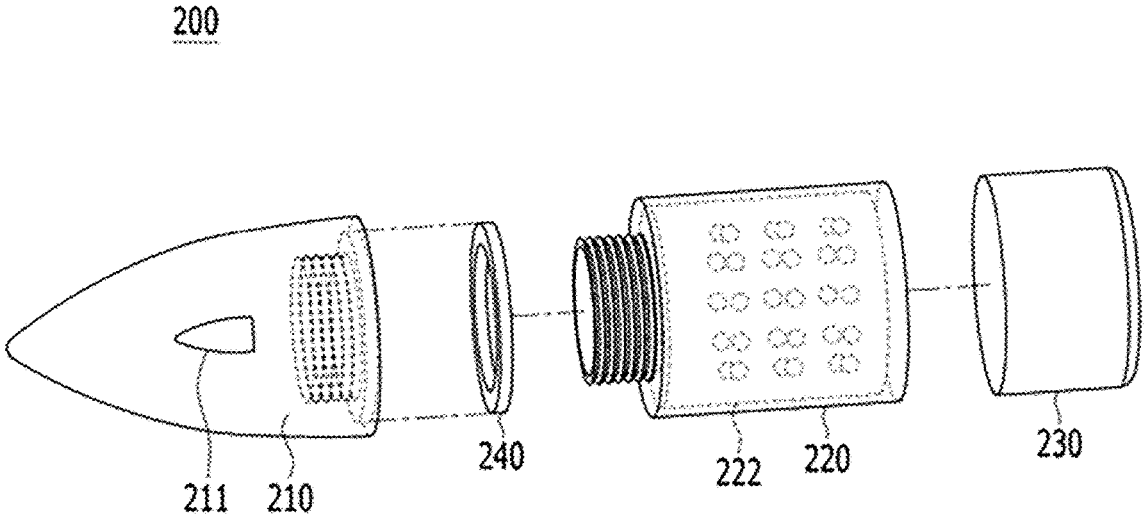
FIG. 4 is a conceptual view of a smart shell according to another embodiment of the present invention.

FIG. 4 is a conceptual view of a smart shell according to another embodiment of the present invention.

Referring to FIG. 4, a smart shell 200 according to another embodiment of the present invention includes a warhead part 220, a cover part 210, and a propulsion part 230.

The warhead part 220 includes a first part 222 in which the scattering pieces P are embedded.

The cover part 210 is detachably coupled to the warhead part 220 so as to cover an upper portion of the warhead part 220. The cover part 210 may have a screw groove on an inner circumference thereof, and the warhead part 220 may have a screw thread on an upper outer circumference correspondingly.

The cover part 210 includes multiple grooves 211 or protrusions 211 on the outer circumference thereof, and the grooves 211 or protrusions 211 cause a difference in rotational speed relative to the warhead part 220 of the shell in the rifling type shell.

A sealing part 240 may be formed between the cover part 210 and the warhead part 220 to maintain internal airtightness. A material forming the sealing part 240 may be the rubber, synthetic resin, or metallic material. The sealing part 240 is formed to be damaged when the rotational speed difference between the cover part 210 and the warhead part 220 is equal to or more than a predetermined level.

The propulsion part 230 has the propellant charge and ignition agent embedded therein, and a hammer mounted on the gun destroys the ignition agent and is fired forward.

Referring to FIG. 1, an example in which the smart shell 100 according to an embodiment of the present invention removes the target T existing in the target area is described as follows.

The smart shell 100 is mounted on a straight, circular gun barrel, and the hammer triggers a rear end of the propulsion part 130 to ignite the ignition agent. A flame generated during ignition is emitted through a flame ball formed at the rear end of the propulsion part 130 and ignites the propellant charge. The propellant charge generates the flame while being burnt, and the flame pushes the warhead part 120 to provide a propulsion force. After the shell is launched, when the shell approaches the target area R, the shell reaches a maximum speed thereof and then gradually slows down, and at this time, the rotational speed of the cover part 110 is rapidly reduced compared to the warhead part 120 due to air resistance. Due to the difference in rotational speed between the warhead part 120 and the cover part 110, the cover part 110 is separated from the warhead part 120. As the cover part 110 is separated, the fuse is activated, and the activated fuse ignites the high explosive. A pressure generated by ignition of the high explosive launches one or more scattering pieces P to the target area R.

Unlike this, when there is no high explosive in the warhead part, as illustrated in FIG. 4, the cover part 110 is separated from the warhead part under a predetermined condition and the embedded scattering pieces may be released to the target area.

As a result, the smart shell may simultaneously hit one or more targets T of the target area R or may intercept an aerial vehicle which is evasively maneuvered.

The configurations and methods of the described embodiments may not be limitingly applied to the smart shell described above, but all or some of the respective embodiments may be selectively combined and configured so as to be variously modified.

The invention claimed is:

1. A smart shell configured to be launched from a gun barrel, the barrel having rifling formed on an inner circumference, and the smart shell formed to hit a target area by using a plurality of scattering pieces, comprising:

a warhead part having the scattering pieces embedded therein;

a cover part having a groove or protrusion provided on an outer circumference, the cover part coupled to cover the warhead part, wherein separation of the cover part from the warhead part is at least initiated by a difference in rotational speed relative to the warhead part when close to the target area;

a propulsion part providing a propulsion force to the warhead part; and wherein the propulsion part is configured to travel with the warhead part at least through the gun barrel.

2. The smart shell of claim 1, further comprising:

a speed control assembly coupled to the cover part to limit a shape of the groove by covering at least a portion of the groove.

3. The smart shell of claim 2, wherein the speed control assembly includes a cover portion covering the groove, a coupling portion coupled to the cover part, and a connection portion connecting the cover portion and the coupling portion, and formed to have a relatively thinner cross-section relative to the cover portion and the coupling portion.

4. The smart shell of claim 3, wherein one side of the cover portion is formed to be thicker than the other side.

5. The smart shell of claim 1, further comprising:

a sealing part inserted between the cover part and the warhead part, wherein the sealing part is formed to be damaged when the rotational speed difference is equal to or more than a predetermined level.

* * * * *